United States Patent [19]

Fortney

[11] Patent Number: 4,965,869

[45] Date of Patent: Oct. 23, 1990

[54] APERTURE ANTENNA HAVING NONUNIFORM RESISTIVITY

[75] Inventor: John D. Fortney, San Diego, Calif.

[73] Assignee: Brunswick Corporation, Skokie, Ill.

[21] Appl. No.: 65,389

[22] Filed: Jun. 23, 1987

[51] Int. Cl.[5] ..... H01Q 19/14

[52] U.S. Cl. ..... 343/781 R; 343/772

[58] Field of Search ..... 343/772, 786, 781 R, 343/840

[56] References Cited

U.S. PATENT DOCUMENTS

| | | | |
|---|---|---|---|
| 2,253,501 | 8/1941 | Barrow | 250/11 |
| 2,692,336 | 10/1954 | Kock | 343/786 |
| 2,743,440 | 4/1956 | Riblet | 343/786 |
| 3,624,655 | 11/1971 | Sato et al. | 343/786 |
| 3,631,504 | 12/1971 | Suetaki | 343/840 |
| 3,831,176 | 8/1974 | Epis et al. | 343/756 |
| 4,141,015 | 2/1979 | Wong et al. | 343/786 |
| 4,198,639 | 4/1980 | Killion | 343/727 |

*Primary Examiner*—William L. Sikes
*Assistant Examiner*—Robert E. Wise
*Attorney, Agent, or Firm*—Finnegan, Henderson, Farabow, Garrett & Dunner

[57] ABSTRACT

An aperture antenna is provided having a substantially smooth and continuous concave reflective surface disposed about a longitudinal axis. The reflective surface has a peripheral edge lying in a first plane substantially perpendicular to the longitudinal axis, a transition boundary lying in a second plane substantially parallel to the first plane, and a transition zone located between the transition boundary and the peripheral edge. The reflective surface has surface resistivity in a selected portion of the transition zone substantially adjacent to the peripheral edge that is nonuniform as a function of positon on the reflective surface.

13 Claims, 3 Drawing Sheets

APERTURE ANTENNA HAVING NONUNIFORM RESISTIVITY

BACKGROUND OF THE INVENTION

1. Field of the Invention

The present invention relates to an aperture antenna such as a horn antenna or a reflector antenna and, more specifically, to an aperture antenna having nonuniform resistive properties in one or more dimensions.

2. Description of the Related Art

The present invention is particularly well suited to aperture antennas which have waveguides as antenna feed lines, such as horn antennas and reflector antennas. Examples of horn antennas include rectangular horns such as E and H plane sectoral and pyramidal horns, circular horns, and other types such as diagonal horns. Examples of reflector antennas include circular, elliptical, parabolic, hyperbolic and cosecant squared antennas.

The waveguide is electromagnetically coupled at one end (a circuit end) to transmit/receive circuitry and at the other end (antenna end) to the aperture antenna to transmit and/or receive electromagnetic signals. The waveguide functions essentially as a transmission line antenna feed, with the antenna and free space serving as the load.

Ideally, all of the electromagnetic energy input into the circuit end of the waveguide by the transmitter is outputted at the antenna end, and the antenna radiates this energy into a desired region in space (target zone) along a longitudinal axis of the antenna corresponding to the main beam or lobe of the antenna. Similarly, external electromagnetic signals propagating into the antenna along the longitudinal axis of the antenna, i.e., from the target zone, ideally are directed to the antenna end of the waveguide by the reflective surface of the antenna so that essentially all of the energy of the received signal is directed to the receiver at the circuit end of the waveguide. In practical antenna systems, however, some portion of the energy being transmitted or received is effectively lost. This effective loss can be attributable to a number of factors related to the design of the antenna.

A number of antenna parameters are used to characterize the design of a given antenna, the selection of which may strongly influence the operation of the system employing the antenna. Examples of these antenna parameters are the voltage standing wave ratio ("VSWR"), side and back lobe structure, and gain.

As with any conventional transmission line, maximum energy transfer occurs when the impedance of the transmission line is equal to that of the load, i.e., the impedances are matched. A poorly matched antenna will result in internal reflections of the signal in the transmission line, which reduce transmitted or received energy of the signal and dissipate a portion of the signal as unwanted thermal energy, correspondingly reducing system performance. The VSWR is the conventional measure of the impedance mismatch between an antenna and its transmission line feed. The VSWR is typically defined as the ratio of the maximum to the minimum voltage (or current) along the transmission line, and preferably has a value at or near unity (1.0). The VSWR of conventional horn antennas is largely attributable to two reflection components, one at the throat of the horn and another at the aperture of the horn. The geometric discontinuities of these locations result in these internal reflections The side lobe structure of an aperture antenna, to a first order approximation, is attributable to diffraction of the transmitted or received electromagnetic wave caused by the abrupt termination of the metallic antenna structure at its aperture. This diffraction has the undesirable effect of spreading the signal energy across a region extending outward away from the main beam as defined by the longitudinal axis of the antenna, and outside the target zone. The signal energy transmitted to or received from the desired target zone corresponding to the longitudinal axis of the antenna is correspondingly reduced. In addition, the presence of significant side lobes increases the difficulty of discriminating signals propagating within the main beam from signals propagating off the main beam, i.e., outside the target zone.

In addition to the main beam and side lobes, a portion of the energy at the antenna will be distributed behind the antenna, more than 90° away from the longitudinal axis along which main beam propagates in front of the antenna. This energy distribution is generally referred to as back lobes.

Antenna gain is a measure of the directivity of an antenna. Gain is dependent upon the geometry of the antenna and the materials from which it is made. Gain is also proportional to the square of the effective cross sectional area of the antenna. Gain may also be dependent upon phase variations across the aperture of the antenna.

Low gain and large side lobes cause a large distribution of energy in the fringe areas of the main beam. This energy is often reflected from local objects outside the target zone such as buildings, trees, and the ground plane. These reflections cause spurious signals which may result in ambiguities or false information.

A number of approaches have been proposed in the past to improve the energy distribution and beam quality of aperture antennas. For example, Sato et al. U.S. Pat. No. 3,624,655, discloses a horn antenna in which a band of dielectric material is arranged circumferentially and symmetrically with the axis of the horn on a part of the inner surface of the horn to produce a transmitted beam having an essentially flat profile. Similarly, Wong et al. U.S. Pat. No. 4,141,015, discloses a conical horn antenna having dual dielectric bands on the interior surface of the horn to cause the dominant and higher order modes of transmitted waves at a single selected frequency to be in phase and add vectorially, which results in a planar wave front. Suetaki et al. U.S. Pat. No. 3,631,504, discloses a parabolic reflector antenna having electromagnetic wave absorbing materials at the circumferential edge or aperture of the antenna. The absorbing materials prevent edge reflections and side lobe radiation associated with the antenna aperture by absorbing a portion of the energy at the peripheral edge region. This reportedly improves side and back lobe radiation.

While each of these and other past attempts to design improved aperture antennas appear to have advanced the state of the art, they generally suffer a number of drawbacks. These and other attempts to control side and back lobe radiation have relied principally on energy absorption and interference cancellation. As a result, they tend to be highly frequency specific, and dependent upon the particular absorbing material and geometries used. Since these designs use bulk dielectric materials on the interior reflective surface of the antenna, they introduce new reflective edges, reduce effective antenna area, and create a barrier to free space.

Thus, the problem of designing an aperture antenna having low side and back lobes and high gain while providing an acceptable VSWR has been an important and largely unmet objective.

SUMMARY OF THE INVENTION

Accordingly, it is an object of the present invention to provide an aperture antenna having reduced side and back lobes while providing improved gain over a range of frequencies.

Another object of the invention is to provide an aperture antenna which improves the impedance match between the antenna and its transmission path, e.g., free space.

Additional objects and advantages of the invention will be set forth in the description which follows, and in part will be apparent from the description, or may be learned by practice of the invention. The objects and advantages of the invention may be realized and obtained by means of the instrumentalities and combinations particularly pointed out in the appended claims.

To achieve the foregoing objects, and in accordance with the purposes of the invention as embodied and broadly described here, an aperture antenna is provided having a substantially smooth and continuous concave reflective surface disposed about a longitudinal axis. The reflective surface has a peripheral edge lying in a first plane substantially perpendicular to the longitudinal axis, a transition boundary lying in a second plane substantially parallel to the first plane, and a transition zone located between the transition boundary and the peripheral edge. The reflective surface has surface resistivity in a selected portion of the transition zone substantially adjacent to the peripheral edge that is nonuniform as a function of position on the reflective surface.

The transition boundary preferably is adjacent to a central region of the antenna, e.g., the throat of a horn antenna and a focal point region of a reflector antenna, and the selected portion includes substantially all of the transition zone.

The surface resistivity of the selected portion along a given dimension of the antenna, preferably the longitudinal dimension, preferably varies at least piecewise continuously and may change monotonically, linearly, or nonlinearly, for example.

In contrast to the absorption and phase cancellation approach to improving energy distribution of the antenna, the present invention uses the approach of selectively controlling surface currents in the antenna to control the distribution of energy. Thus, the present invention does not have the disadvantage of actual or effective losses associated with energy absorption, and the frequency specificity of these conventional approaches.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention. Of the drawings.

DESCRIPTION OF THE PREFERRED EMBODIMENTS

Figure 1A:
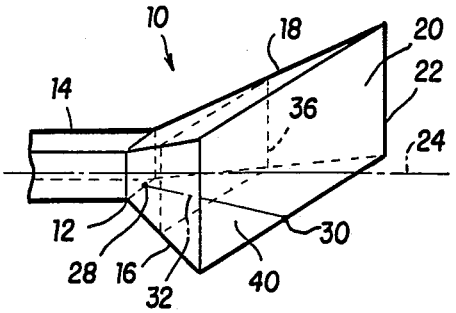
FIGS. 1A, 1B and 1C show perspective, front and side views, respectively, of a pyramidal horn antenna which incorporates the features of the present invention in a first preferred embodiment.

Reference will now be made in detail to the presently preferred embodiments of the invention as illustrated in the accompanying drawings, in which like reference characters designate like or corresponding parts throughout.

Figure 1B:
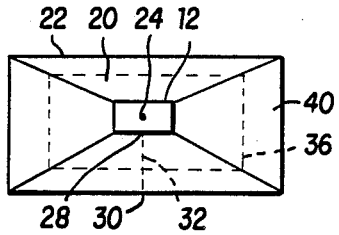
Figure 1C:
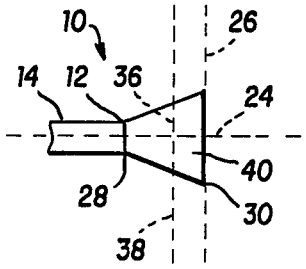

A pyramidal horn antenna which incorporates the features of the present invention in a first preferred embodiment is shown in FIGS. 1A through 1C, wherein FIG. 1A is a perspective view, FIG. 1B is a front view, and FIG. 1C is a side view. The horn 10 has a throat 12 at which it is coupled to a waveguide 14. Horn 10 includes a wall portion 16 having an outer surface 18, an inner concave reflective surface 20, and a peripheral edge 22. Concave as used here means a three-dimensional surface having a single direction of curvature toward the front of the antenna (in the direction of the main beam) and wherein its radius or radii of curvature lie in front of the antenna. The concave reflective surface 20 is substantially smooth and continuous to avoid adding or accentuating unwanted reflections, and is disposed about a longitudinal axis 24 which extends from the center of waveguide 14 parallel to the propagation direction of a signal transmitted from the waveguide at throat 12. Peripheral edge 22 lies in a first plane 26 (FIG. 1C) substantially perpendicular to longitudinal axis 24. Axis 24 passes through the first plane at or near the center of a two-dimensional projection of peripheral edge 22 on first plane 26 as viewed from a position directly in front of the aperture antenna in the center of its main beam (FIG. 1B).

In a transmission mode, electromagnetic waves originate at a radiating element in waveguide 14 which is coupled to transmit/receive circuitry (not shown) and propagate down waveguide 14 and outwardly from the concave reflective surface 20 of horn 10 along longitudinal axis 24 into a target zone in front of and along the main beam of antenna 10. In a receive mode, electromagnetic waves travelling within the target zone toward horn 10 parallel to longitudinal axis 24 arrive at reflective surface 20 where they are converged to a central region at throat 12 from which they are propagated along waveguide 14 to the transmit/receive circuitry (not shown).

In conventional horn antennas, reflective surface 20 of horn 10 is conductive and has essentially constant resistive properties, e.g., the surface resistance of reflective surface 20 along the longitudinal dimension of the horn 10 has a constant value. The value of this resistivity influences the resultant VSWR and beam pattern of the antenna since it impacts the impedance and reflectivity of the antenna.

Figure 2:
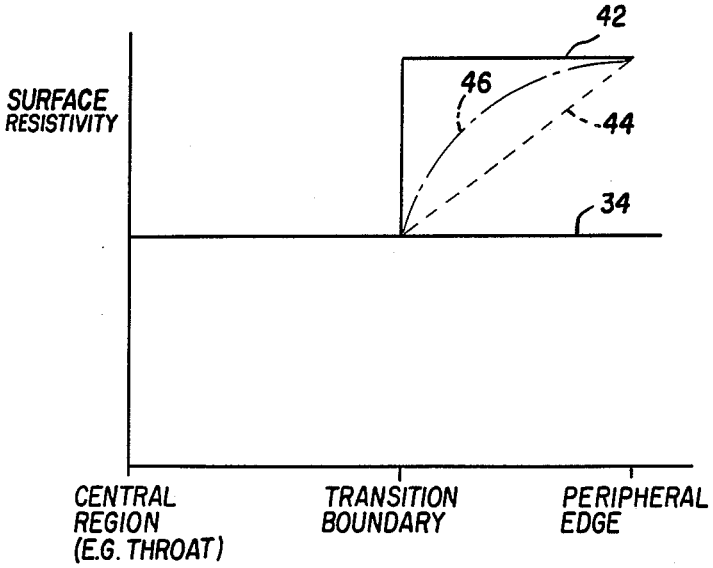
FIG. 2 shows a graph of surface resistivity versus position along the longitudinal dimension of the reflective surface for the aperture antenna of the present invention.

The resistivity of reflective surface 20 may be visualized by selecting a point 28 along the edge of throat 12 and a point 30 on peripheral edge 22 closest to point 28 to form a line 32 on reflective surface 20 along the longitudinal dimension of horn 10, and measuring surface resistivity of reflective surface 20 along line 32. The resistivity of reflective surface 20 as a function of position along line 32 between point 28 and point 30 along line 32 is shown in FIG. 2. The resistivity of conventional horn antennas can be seen to be constant at all points along line 32 (FIG. 1), as shown by solid line 34 in FIG. 2.

In accordance with the present invention, reflective surface 20 of horn 10 includes a transition boundary 36 lying in a second plane 38 substantially parallel to first plane 26 (FIG. 1C), and a transition zone 40 located between transition boundary 36 and peripheral edge 22. As embodied herein, the resistivity of a selected portion of reflective surface 20 within transition zone 40 and substantially adjacent to peripheral edge 22 is nonuniform as a function of position on reflective surface 20. In the present embodiment, transition boundary 36 is adjacent to a central region of horn 10, e.g., throat 12, in which case transition zone 40 includes essentially the entire reflective surface 20 of horn 10. Preferably, the selected portion of reflective surface 20 within transition zone 40 includes the entire transition zone 34. However, the invention is not limited in this sense so that the selected portion may include less than the entire transition zone. For example, two opposing walls of a pyramidal or sectoral horn antenna such as those parallel to the E plane (the plane in which lies the electric field vector of the wave) or a portion of these walls within transition zone 40 may constitute the selected portion of reflective surface 20.

The resistivity profile (surface resistivity as a function of position) of the concave reflective surface 20 of a horn incorporating the principles of the first preferred embodiment is selected to soften the transition of impedance between the horn and free space. Given this objective, the resistivity profile of the selected portion of surface 20 within transition zone 40 may be distributed in a number of ways. With reference to FIG. 2, surface resistivity of reflective surface 20 as a function of distance along line 32 from point 28 at throat 12 to point 30 on peripheral edge 22 may in one example be a unit step function 42 in which resistivity increases in a piecewise linear fashion from a first uniform and preferably low value (near throat 12) to a second uniform and preferably high value at peripheral edge 22.

As another example, the resistivity profile of reflective surface 20 taken along line 32 within the selected portion of reflective surface 20 may change monotonically, i.e., be non-increasing or non-decreasing, preferably being non-decreasing. This resistivity profile may be continuously graded (i.e., have finite derivatives at all points along line 32), for example, linearly as shown in FIG. 2 by function 44, or nonlinearly as shown by function 46.

Figure 3:
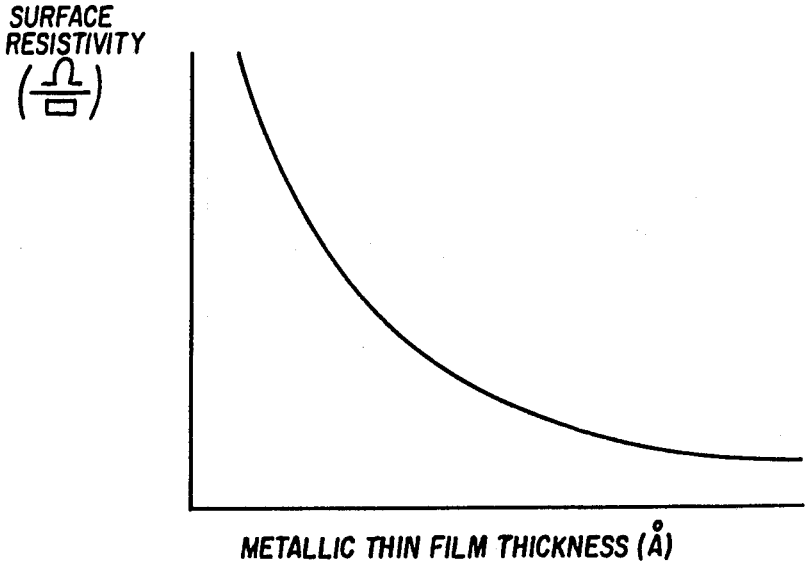
FIG. 3 shows the relationship between the thickness of a metallic thin film and the corresponding surface resistivity.

The preferred method for obtaining the surface resistivity profiles shown in FIG. 2 involves applying a metallic thin film using known vacuum deposition techniques, such as sputtering or chemical vapor deposition. In these methods, local areas of the selected portion of transition zone 40 are exposed under carefully controlled conditions to a gaseous plasma environment comprising a metallic composition to deposit a metallic thin film of preselected thickness. The metallic composition may include one or more elements or compounds from a wide variety of candidates. These candidates include but are not limited to aluminum, palladium, gold, oxides, nitrides and cermets. The specific metallic composition selected depends on the substrate material on which the thin film will be deposited and the desired resistivity profile. Local surface resistivity on the surface at the selected portion of transition zone 40 is determined in this example by varying the local thickness of the metallic thin film. The relationship between the thickness of the thin film and the surface resistivity, an example of which is shown in FIG. 3, is used to select the desired thickness of the thin film at a given location on surface 20.

The first preferred embodiment of the invention is shown in FIG. 1 and described above as being applied to a pyramidal horn antenna. This is by way of illustration and not limitation. For example, the principles of the invention may be applied to other horn antenna designs such as a circular or diagonal horn antenna in a similar and analogous fashion.

The features of the present invention may be incorporated into a conventional horn antenna in a second preferred embodiment of the present invention by attaching one or more surfaces, for example, rigid or semi-rigid edge cards or similar resistive materials, to the aperture edge of the horn, as will now be described with reference to FIGS. 4A through 4C.

Figure 4A:
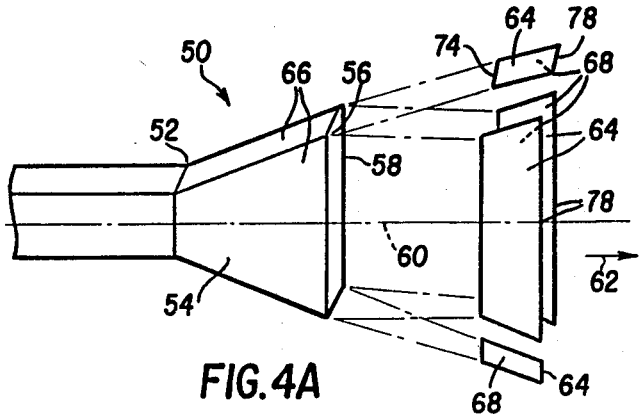
FIG. 4A shows an expanded perspective view of an E sectoral horn antenna having edge cards in a second embodiment of the present invention.

A conventional E plane sectoral horn 50 is shown in FIG. 4A. Horn 50 includes a throat 52, walls 54, and a reflective surface 56. Reflective surface 56 includes a peripheral edge 58, and is disposed about a longitudinal axis 60. The surface resistivity of reflective surface 56 in the longitudinal direction (arrow 62) is uniform, as shown by curve 34 in FIG. 2.

In this preferred embodiment, edge cards 64 are used to provide one or more regions of nonuniform surface resistivity on the interior reflective surface of horn 50, thereby extending corresponding ones of the wall segments 66 in the longitudinal direction of the horn. The surface resistivity may have any of the profiles described above, examples of which are shown in FIG. 2.

Figure 4B:
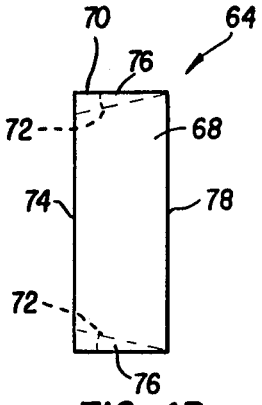
FIG. 4B shows a substrate from which one of the edge cards shown in FIG. 4A is made.
Figure 4C:
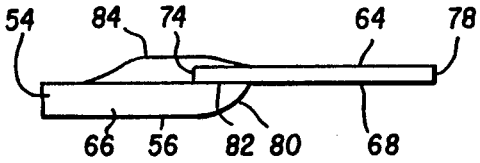
FIGS. 4C and 4D illustrate bonding methods for bonding the edge cards to the horn as shown in FIG. 4A.

With reference to FIGS. 4A and 4B, each of the edge cards 64 can comprise any material which will provide the desired surface resistivity profile or which can be modified to have such profile, for example, by applying a surface coating. The edge cards of this preferred embodiment preferably are made from a flexible or formable sheet substrate material, such as polyimides, polyamides, polyesters, polytetrafluoroethylenes, fiberglass, and cloth fabrics. Where a unit step variation in surface resistivity is desired, as shown by curve 42 of FIG. 2, each of the edge cards 64 may comprise a thin metallic sheet. Where a linear or nonlinear variation in resistivity is desired, as shown by curves 44 and 46 of FIG. 2, an electromagnetic reflecting material such as a thin metallic film as described above may be applied to a reflective surface 68 of each edge card substrate to vary the surface resistivity of the card, for example, along the dimension corresponding to the longitudinal direction of horn 50 as indicated by longitudinal axis 60. Application of the metallic film to surface 56 of horn 50 may be accomplished in a variety of ways, but is preferably accomplished using a sputtering process as described above. In this sputtering process, a rectangular sheet 70 of substrate material is exposed in a controlled fashion to a gaseous or plasma environment comprising metallic elements or compounds, examples of which are provided above. The deposition of the gas or plasma is controlled in coordination with data such as the thickness-resistivity curve shown in FIG. 3 to obtain a desired surface resistivity profile on surface 68 of substrate 70.

After treating surface 68 of substrate 70 with the metallic material to obtain the desired surface resistivity profile, substrate 70 is then cut or otherwise shaped to conform to the dimensions of the corresponding wall 66 of horn 50, as indicated by the perforated lines 72 in FIG. 4B. Specifically, substrate 70 is cut so that an inward edge 74 of edge card 64 has the same length as and conforms to the corresponding aperture edge 58 of horn 50, and the angle 76 of the cut is substantially equivalent to the flare angle of the horn.

Each edge card is then bonded to horn 50 to join aperture edge 58 to inward edge 74 of edge card 64 so that the reflective surface 68 of each edge card faces inwardly toward the interior (longitudinal axis 60) of horn 50 and forms a continuous and substantially coplanar surface with surface 56. Thus, edge cards 64 extend the reflective surface and form a new peripheral edge 78 of horn 50. This increases the effective area of horn 50, and correspondingly increases gain.

Bonding may be accomplished using a number of conventional methods. However, care must be exercised to ensure that the reflective surface of horn 50, which now extends between throat 52 and peripheral edge 78, is substantially smooth and coplanar, and that it is mechanically and electrically continuous, particularly at and along the bond.

The edge cards of the preferred embodiment are preferably bonded as follows. The aperture edge 58 of horn 50 is chamferred to remove an interior portion of walls 54, thus creating a beveled edge 80. The metallic surface 68 of each edge card is then placed in contact with an exterior end region of the corresponding wall 54 to create an overlap 82. A bonding material 84 such as an epoxy resin is applied to the exterior of edge card 64 and wall 54. The bonding material preferably is dielectric material formed to have rounded edges and minimal thickness, and to secure edge card 64 so that reflective surface 68 of edge card 64 is in intimate contact with reflective surface 56 of horn 50.

Figure 4D:
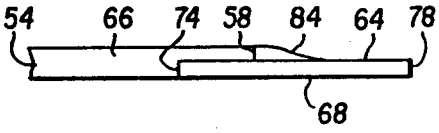

The bonding method of the present invention is not limited to that described above. For example, as shown in FIG. 4D, a groove 86 could be formed in the interior portion of wall 66 at aperture edge 58, the depth of which corresponds to the thickness of edge card 64 after application of the thin film. Bonding material 84 could then be applied to the exterior portion of edge card 64 and aperture edge 58 to provide a thin dielectric support structure. It is desirable with this bonding method to apply the metallic thin film to interior edge 74 of edge card 64 to provide electrical continuity with surface 56.

Attachment of edge cards 64 as described here provides the appropriate resistivity profile on surface 68, i.e., a transition zone, while extending and maintaining the substantially smooth and continuous concave reflective surface. Furthermore, by extending the reflective surface, edge cards 64 increase the area of the antenna and correspondingly increase antenna gain.

As a specific example of the second preferred embodiment, a Narda pyramidal horn antenna approximately 5 inches long with a 2.5 inch by 3.5 inch aperture and an approximately 25° taper was retrofitted with edge cards approximately 2 inches in length (along the longitudinal axis of the horn) having a polyimide sheet substrate and a palladium metallic thin film. The resistivity profile of the edge card was linear, as shown by curve 44 of FIG. 2, and varied from a low resistivity at the transition boundary (edge 74 of FIG. 4) of 2 ohms per square to a high resistivity at peripheral edge 78 of edge card 64 of 1200 ohms per square. This configuration resulted in substantial reductions in side and back lobe radiation.

An edge card can similarly be used to adapt other conventional horn designs, such as a conventional circular horn antenna, to embody the principles of the present invention, essentially as shown and described above.

It is to be understood that the present invention is not limited to the illustrative embodiments described here. For example, as an additional improvement over conventional horn antenna designs, an insert such as a conventional lens insert for a horn antenna could be placed in the interior of edge cards 64 to provide for nonuniform surface resistivity in accordance with the invention while also providing for phase correction to improve gain, and to serve as an environmental seal for the horn. Similarly, the exterior surface walls such an insert could be treated with a metallic film as described above with regard to edge cards 64 to produce the desired variation in surface resistivity profile on the concave reflecting surface of the horn. The insert could extend outside aperture edge 58 of horn 10 to extend reflective surface 56, thereby obtaining the advantages of higher gain as discussed above for edge cards 64.

Figure 5:
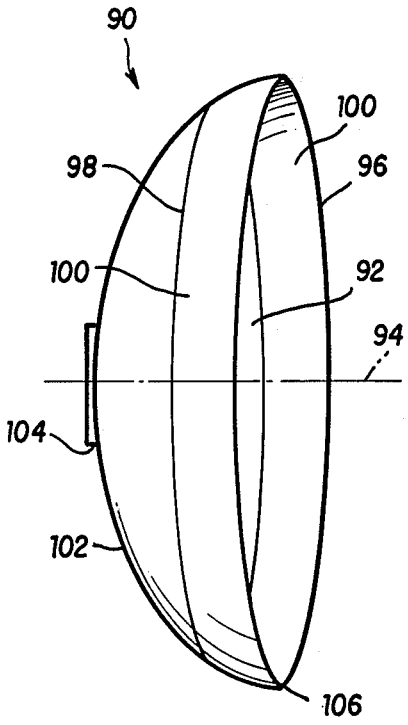
FIG. 5 shows a parabolic reflector antenna which incorporates the features of the present invention in a third preferred embodiment.

FIG. 5 shows a third preferred embodiment of the present invention as applied to a parabolic reflector antenna. As with the horn antenna described above, the parabolic reflector 90 has a substantially smooth and continuous concave reflective surface 92 disposed about longitudinal axis 94. Reflective surface 92 has a peripheral edge 96 lying in a plane substantially perpendicular to longitudinal axis 94 and corresponding to first plane 26 (FIG. 1C). Reflective surface 92 also has a transition boundary 98 which lies in a plane corresponding to second plane 38 which is substantially parallel to the first plane. Reflective surface 92 also has a transition zone 100 lying between transition boundary 98 and peripheral edge 96.

In contrast to conventional parabolic reflector antennas which have essentially uniform surface resistivity over the entire reflective surface (curve 34 of FIG. 2), reflective surface 92 of reflector antenna 90 has resistivity in a selected portion of transition zone 100 adjacent peripheral edge 96 that is nonuniform as a function of position on the reflective surface.

The resistivity profile of reflective surface 92 within the selected portion may be measured along a line 102 extending from a point 104 in a central region of surface 92, such as the rim of the unilluminated region below the feed at the focal point of the paraboloid comprising the antenna, to a point 106 on peripheral edge 96 closest to point 104. The surface resistivity along line 102 may have one or more of the profiles shown by curves 42, 44 and 46 of FIG. 2. Accordingly, parabolic reflector 90 of the third preferred embodiment provides the advantages of horn antenna 10 of the first preferred embodiment.

The surface resistivity profiles of reflector antenna 90 may be obtained using a number of methods, as noted above. For example, a metallic thin film may be appropriately applied to the selected portion by sputtering the metallic thin film onto the existing surface of the antenna as described above. The thickness of the metallic thin film is varied in accordance with the desired local resistivity while maintaining a substantially continuous parabolic surface.

A conventional parabolic reflector may also be modified in accordance with the principles of the invention using one or more edge cards, essentially as was described above with regard to FIGS. 4A through 4D. In addition, both a reflector antenna and its feed horn could embody the principles of the invention to obtain the advantages of the invention.

Additional advantages and modifications will readily occur to those skilled in the art. Therefore, the invention in its broader aspects is not limited to the specific details, representative devices, and illustrative examples shown and described. Accordingly, departures may be made from such details without departing from the spirit or scope of the general inventive concepts defined by the appended claims and their equivalents.

What is claimed is:

1. An aperture antenna having a substantially smooth and continuous reflective surface disposed about a longitudinal axis, said reflective surface having a peripheral edge lying in a first plane substantially perpendicular to said longitudinal axis, a transition boundary lying in a second plane substantially parallel to and spaced from said first plane, and a transition zone located between said transition boundary and said peripheral edge, a selected portion of said transition zone having nonuniform resistivity along said reflective surface axially.

2. An aperture antenna as recited in claim 1, wherein the surface resistivity of said selected portion of said transition zone varies at least piecewise continuously along said reflective surface axially.

3. An aperture antenna as recited in claim 1, wherein the surface resistivity of said selected portion of said transition zone varies continuously along said reflective surface axially.

4. An aperture antenna as recited in claim 1, wherein the resistivity of said selected portion of said transition zone varies monotonically along said reflective surface axially.

5. An aperture antenna as recited in claim 1, wherein the resistivity of said selected portion of said transition zone varies linearly along said reflective surface axially.

6. An aperture antenna as recited in claim 1, wherein the resistivity of said selected portion of said transition zone varies nonlinearly along said reflective surface axially.

7. An aperture antenna as recited in claim 1, wherein said transition zone includes an edge card having a substrate member and a reflective film disposed on a portion of said substrate member.

8. An aperture antenna having a reflective surface disposed about a longitudinal axis extending along a longitudinal dimension, said reflective surface having a peripheral edge lying in a first plane substantially perpendicular to said longitudinal axis, a transition boundary lying in a second plane substantially parallel to and spaced from said first plane, and a transition zone located between said transition boundary and said peripheral edge, a selected portion of said transition zone having nonuniform resistivity along said longitudinal dimension.

9. An aperture antenna as recited in claim 8, wherein the resistivity of said selected portion of said transition zone varies monotonically along said longitudinal dimension.

10. An aperture antenna as recited in claim 8, wherein the resistivity of said selected portion of said transition zone varies linearly along said longitudinal dimension.

11. An aperture antenna as recited in claim 8, wherein the resistivity of said selected portion of said transition zone varies nonlinearly along said longitudinal dimension.

12. An aperture antenna as recited in claim 8, wherein said transition zone includes an edge card having a substrate member and a reflective film disposed on a portion of said substrate member.

13. An aperture antenna having a reflective surface disposed about a longitudinal axis, said reflective surface having a peripheral edge lying in a first plane substantially perpendicular to said longitudinal axis, a transition boundary lying in a second plane substantially parallel to and spaced from said first plane, and a transition zone located between said transition boundary and said peripheral edge, a selected portion of said transition zone having nonuniform resistivity along a line defined by a first point on said transition boundary and a second point on said peripheral edge closer to said first point than any other points on said peripheral edge.

* * * * *